US005635686A

United States Patent [19]

Fenton

[11] Patent Number: 5,635,686

[45] **Date of Patent: *Jun. 3, 1997**

[54] COMPOSITE SPEAKER SYSTEM HAVING A DIRECTIONAL ADJUSTABLE TWEETER

[76] Inventor: Robert Fenton, 28003 W. Via Amistosa, Agoura Hills, Calif. 91301

[ * ] Notice: The term of this patent shall not extend beyond the expiration date of Pat. No. 5,512,714.

[21] Appl. No.: 533,013

[22] Filed: Sep. 25, 1995

Related U.S. Application Data

[62] Division of Ser. No. 264,739, Jun. 23, 1994, Pat. No. 5,512,714.

[51] Int. Cl.[6] ..... H04R 15/00

[52] U.S. Cl. ..... 181/144; 181/163; 381/186

[58] Field of Search ..... 181/144, 150, 181/154, 163, 199, 141; 381/184, 185, 186, 86

[56] References Cited

U.S. PATENT DOCUMENTS

| | | | |
|---|---|---|---|
| 2,231,479 | 2/1941 | Perry . | |
| 3,213,209 | 10/1965 | Doelitzsch . | |
| 3,379,276 | 4/1968 | Goettl . | |
| 3,754,618 | 8/1973 | Sasaki . | |
| 4,182,429 | 1/1980 | Senzaki . | |
| 4,365,114 | 12/1982 | Soma . | |
| 4,492,826 | 1/1985 | Chiu | 381/186 |
| 4,552,242 | 11/1985 | Kashiwabara | 181/144 |
| 4,553,630 | 11/1985 | Ando | 181/144 |
| 4,554,414 | 11/1985 | House . | |
| 4,811,406 | 3/1989 | Kawachi | 381/186 |
| 5,133,428 | 7/1992 | Perrson . | |

*Primary Examiner*—Khanh Dang

*Attorney, Agent, or Firm*—Thomas I. Rozsa; Tony D. Chen

[57] ABSTRACT

A composite speaker system includes a tweeter or high frequency transducer attached to an adjustable flexible arm or arms which is mounted directly to the pole piece or adapter member connected to the pole piece of a woofer or low frequency transducer. The tweeter can be adjusted in any direction to improve the sound quality because the listener can actually aim the tweeter at himself or herself and the composite speaker system can be mounted anywhere in an automobile or room.

17 Claims, 3 Drawing Sheets

COMPOSITE SPEAKER SYSTEM HAVING A DIRECTIONAL ADJUSTABLE TWEETER

This application is a Division of the patent application Ser. No. 08/264,739 filed on Jun. 23,1994, now U.S. Pat. No. 5,512,714.

BACKGROUND OF THE INVENTION

1. Field of the Invention

The present invention generally relates to the field of electrodynamic speakers. More particularly, the present invention relates to the field of directional adjustable audio speaker systems for automotive vehicles.

2. Description of The Prior Art

Generally, audio speaker systems are well known in the art. These speaker systems cannot always be mounted in the ideal location in vehicles because most factory speakers are mounted in the vehicle's doors, and most aftermarket replacement speakers are mounted in the same spot and therefore do not improve the sound quality of the speaker.

In some prior art applications, a tweeter is mounted into a housing which is mounted to the speaker and is flush with the grill. The disadvantage with this prior art design is that when the tweeter swivels in the housing, the tweeter is partially blocked by its own housing and the quality of the sound is distorted. Another disadvantage is that the tweeter can only swivel to a certain degree because of the constraints at the periphery of the housing. In another prior art design, the tweeter is mounted on the grill and is rotatable by loosening or tightening a knob. The disadvantage of this design is that it cannot be used with existing grills that are already mounted in the vehicle.

The following eight (8) prior art patents were uncovered in the pertinent field of the present invention.

1. U.S. Pat. No. 2,231,479 issued to Perry on Feb. 11, 1941 for "Signal Translating Apparatus" (hereafter "the Perry Patent").

2. U.S. Pat. No. 3,213,209 issued to Doelitzsch on Oct. 19, 1965 for "Loudspeaker" (hereafter "the Doelitzsch Patent").

3. U.S. Pat. No. 3,379,276 issued to Goettl on Apr. 23, 1968 for "Speaker Installation Means" (hereafter "the Goettl Patent").

4. U.S. Pat. No. 3,754,618 issued to Sasaki on Aug. 28, 1973 for "Speaker System" (hereafter "the Sasaki Patent").

5. U.S. Pat. No. 4,182,429 issued to Senzaki on Jan. 8, 1980 for "Loud-Speaker System" (hereafter "the Senzaki Patent").

6. U.S. Pat. No. 4,365,114 issued to Soma on Dec. 21, 1982 for "Automotive Loudspeaker Having Variable Speaker Orientation And Particular Electrical Connections" (hereafter "the Soma Patent").

7. U.S. Pat. No. 4,554,414 issued to House on Nov. 19, 1985 for "Multi-Driver Loudspeaker" (hereafter "the House Patent").

8. U.S. Pat. No. 5,133,428 issued to Perrson on Jul. 28, 1992 for "Direction-Adjustable Speaker System" (hereafter "the Perrson Patent").

The Perry Patent discloses a signal translating apparatus. It includes a large conical diaphragm adapted to particularly radiate the lower frequencies and a small diaphragm nested concentrically with the large diaphragm and adapted to particularly radiate the higher frequencies. The Perry Patent does not have an adjustable means.

The Doelitzsch Patent discloses a loudspeaker. It includes a woofer cone and a tweeter cone. A voice coil is mounted to an elongated tube and the tweeter cone is permanently mounted to the forward end of the tube. The Doelitzsch Patent is a conventional loudspeaker which does not have an adjustable means.

The Goettl Patent discloses a speaker installation means. It includes a triangular frame which is disposed to close a corner recess of a building room, ceiling and wall structure. The frame provides an adjustably supported means for supporting a speaker therein. The perimeter of the speaker does not extend out from the frame.

The Sasaki Patent discloses a speaker system. A speaker box is supported within a frame body by shafts provided at the right and left sides, so that the speaker box is allowed to rotate around the horizontal extended shafts and a middle range speaker and a tweeter are included in the speaker box mounted on a baffle. This has the same disadvantage as mentioned above, where the speaker box is rotated within the frame body and is partially blocked by its own housing and the quality of the sound is distorted. This is a home unit and does not relate to car speakers.

The Senzaki Patent discloses a loud speaker system. It includes a woofer speaker and a tweeter speaker which is disposed substantially coaxially to the woofer speaker. The tweeter is mounted to a support plate which is disposed within the opening of the woofer speaker. The pivotal movement of the support plate is carried out stepwise by the alternate engagement of balls held in holes formed in the web portions of the bridge members with the detents formed in the side plate portions of the support plate.

The Soma Patent discloses a composite speaker system for automotive vehicles. It includes a low range speaker unit, a medium or high range speaker unit and an attachment member. The attachment member is attachable to and detachable from an outer peripheral portion of a frame member and provides a protection to the open surface of the low range speaker. The attachment member includes an annular ring portion, a hub portion and spokes which radially extend from the hub portion to the inside wall of the annular ring portion. The medium speaker unit is coupled to the hub portion of the attachment member. The medium speaker can be varied in the vertical direction by adjustment of a knob. Upon loosening the knob, the medium speaker can be rotated about the knob whereas by tightening the knob, the medium speaker can be secured at any possible position. In the second embodiment of the Soma Patent, the medium speaker is designed to be rotatable in the horizontal and the vertical plane.

The House Patent discloses a multi-driver loudspeaker. It includes a woofer speaker and a tweeter speaker which is mounted within the woofer speaker. The tweeter cone is suspended in front of the woofer cone in several ways. The tweeter perimeter can be attached to the woofer cone directly, or through a compliant member. The tweeter cone can be suspended in front of the woofer cone, with no physical contact between the cones, by supporting the tweeter cone from its crystal driver and attaching the crystal driver directly to the voice coil form of the woofer. The mounting structure permits orientation of the tweeter speaker axis at an angle to the axis of the woofer speaker. In the House Patent, the conventional pole piece which supports the tweeter speaker is eliminated.

The Perrson Patent discloses a direction adjustable speaker system. It teaches a swivel speaker system to custom aim sound emanating from the speaker. It includes a sound driver which is secured within a rotatable mount, which is itself secured within a housing by means of a retainer. The disadvantage in this design is that the sound emanating from the tweeter is partially blocked by the housing.

It will be desireable to design a novel composite speaker system for automotive vehicles in which a tweeter is mounted to an adjustable flexible arm which is mounted to a speaker, so that a listener can adjust the tweeter to improve the sound quality because the tweeter can be aimed at the listener in the vehicle.

SUMMARY OF THE INVENTION

The present invention is a novel and unique composite speaker system which relates to existing aftermarket replacement speakers. The composite speaker system has an adjustable tweeter mounted within a woofer or the like.

The object of the present invention is to have a tweeter or high frequency transducer attached to an adjustable flexible arm or arms which is mounted to the pole piece or adapter member connected to the pole piece of a woofer or low frequency transducer. This design will make it a coaxial, two-way type speaker with an adjustable tweeter. A listener can adjust the tweeter to improve the sound quality because the listener can actually aim the tweeter at himself or herself and the composite speaker system can be mounted anywhere in the car, for example factory locations such as in the vehicle's doors. This aiming capability gives the listener up-front and live-performance sound.

The present invention can also used with a midrange speaker in a three or four way type configuration speaker system.

It is therefore an object of the present invention to provide a composite speaker system particularly suitable for automotive vehicles in which a woofer or low frequency transducer is mounted to a door of the vehicle while a tweeter or high frequency transducer is mounted within the woofer and is freely adjustable in any direction to precisely aim sound radiating from the tweeter towards a listener.

It is also an object of the present invention to provide a composite speaker system which includes an adjustable flexible arm or arms made of flexible metal material which is attached to an elongated cylindrical shaped adapter means such that the adapter means can be mounted to a pole piece of a woofer, so that a tweeter can be attached to the adjustable flexible arm, and the direction of the sound radiating from the tweeter can be adjusted by adjusting the adjustable flexible arm.

It is a further object of the present invention to provide an elongated adapter means which has a wide flat platform top end so that two or three adjustable tweeters or transducers can be attached to the platform to provide a two or three way type configuration speaker system.

It is an additional object of the present invention to provide a single assembly having a combination of two or more tweeters or transducers in which the high frequency transducers are mounted with respect to the low frequency transducer.

In one embodiment of the present invention, the composite speaker system includes a tweeter or high frequency transducer and a woofer or low frequency transducer. The tweeter is attached to an adjustable flexible arm which is mounted to an elongated adapter means. The adapter means is mounted to a pole piece of the woofer, so that the tweeter can easily be adjusted in any direction to improve the sound quality of the composite speaker system.

In another embodiment of the present invention, the composite speaker system includes a tweeter and a woofer. An elongated arm has ball joints at one or both ends and are respectively attached to the tweeter and an adapter means.

In a further embodiment of the present invention, the composite speaker system includes multiple tweeters or transducers, a woofer and an adapter means which has a wide flat platform. The transducers are attached to adjustable flexible arms which are mounted to the platform of the adapter means. The adapter means is then mounted to a pole piece of the woofer.

In an additional embodiment of the present invention, the composite speaker system includes a tweeter and a woofer. The tweeter is attached to an adjustable flexible arm which is directly mounted to an extended pole piece of the woofer.

In a further additional embodiment of the present invention, the composite speaker system includes a tweeter, a woofer and an elongated rod. The tweeter is attached to an adjustable flexible arm which is mounted to an adapter means which is in turn mounted to the pole piece of the woofer. The elongated rod is attached to the side of the tweeter and extends outwardly through an enlarged slot aperture on a grill member so that a listener can easily adjust the tweeter without removing the grill member from the woofer.

In general, the uniqueness of the present invention is that the aiming capability gives the listener up-front and live-performance sound radiating from the tweeter towards the listener.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
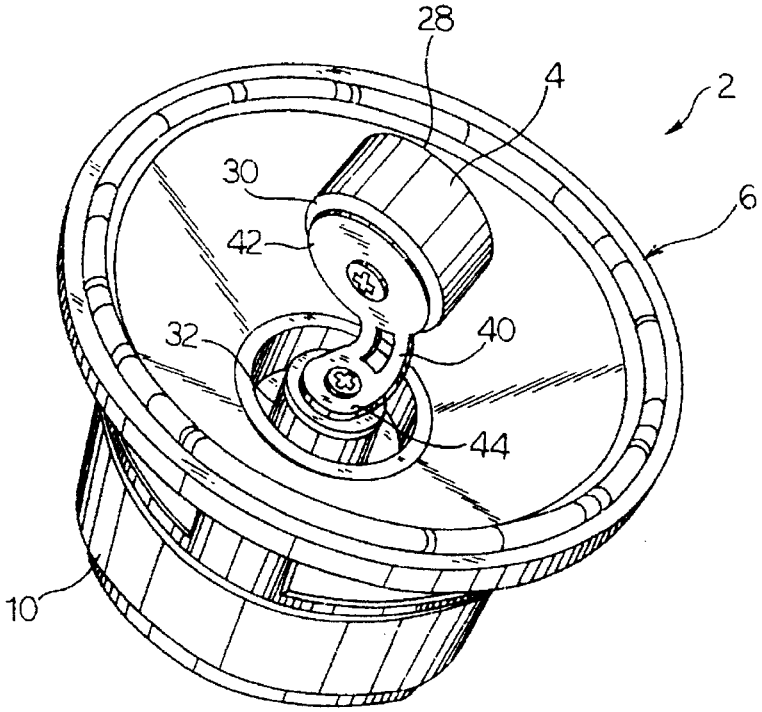
FIG. 1 is a perspective view of one embodiment of the present invention composite speaker system having a directional adjustable tweeter and a woofer (for clarity the grill member is not shown).
Figure 2:
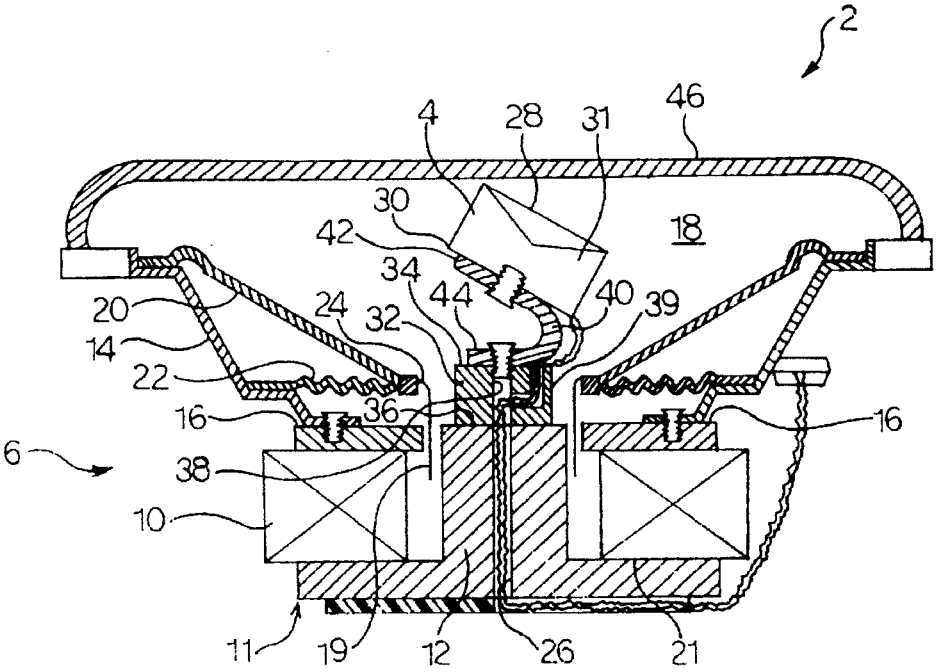
FIG. 2 is a cross-sectional view of the embodiment shown in FIG. 1, where a tweeter is attached to an adjustable flexible arm which is mounted to an elongated adapter means which in turn is mounted to a pole piece of a woofer.

FIGS. 1 and 2 illustrate one embodiment of the present invention composite speaker system 2. Referring to FIGS. 1 and 2, there is shown the composite speaker system 2 which represents a system of the coaxial, two way type configuration. The composite speaker system 2 includes a tweeter or high frequency transducer 4 and a woofer or low frequency transducer 6. The woofer 6 is for reproducing low frequency sounds which is of the well known permanent-magnet, moving coil type comprising a magnet circuit 11, a magnet 10, a bottom plate 21, a pole piece 12 and a top plate 16. A frame 14 is secured to the top plate 16. The frame 14 has a generally conical configuration and defines an open space 18 which is also generally the frontal area of the woofer 6. The shape of the open space 18 formed by the frame 14 can be other than circular shaped, such as oval shaped. A damper or spider 22 has an outer edge which is mounted to the frame 14 and an inner edge which is coupled to an inner edge of a diaphragm 20. The diaphragm 20 extends or flares generally conically outwardly and has its outer edge secured to the periphery of the frame 14. Both the damper 22 and the diaphragm 20 are mounted within the open space 18 of the frame 14. The coupled inner edges of the damper 22 and the diaphragm 20 form a central opening 24. A central portion of the diaphragm 20 is attached to a voice coil bobbin 19 which carries a voice coil (not shown). The pole piece 12 has an opening 26 therethrough. Up to this point of the description, the construction of the woofer 6 is essentially conventional.

The tweeter 4 is for reproducing high frequency sounds. The tweeter 4 includes a front side 28, a back side 30 and a diaphragm 31, the central axis of which can be aligned with the central axis of the diaphragm 20 of the woofer 6 or off the central axis of the diaphragm 20 of the woofer 6. The diaphragm 31 of the tweeter 4 has a substantially smaller dimension than that of the diaphragm 20 of the woofer 6. The electrical wiring of the tweeter 4 is wired in an essentially conventional manner.

The present invention utilizes an elongated cylindrical shaped adapter member 32 or supporting structure which has a top end 34, a bottom end 36, a central opening 38 extending from the top end 34 to the bottom end 36 and a small aperture 39 located at the top end 34 off center and adjacent to the central opening 38. The small aperture 39 extends downwardly and intersects with the central opening 38 at a midpoint location on the adapter member 32 for allowing electrical wires of the tweeter 4 to be inserted through the bottom end 36 and the opening 26 of the pole piece 12 and be connected to input terminals mounted upon a portion of the frame 14. The opening 38 of the adapter member 32 is aligned with the central opening 26 on the pole piece 12 and fixedly secured thereto by adhesive or epoxy means. The top end 34 of the adapter member 32 extends above the central opening 24 formed by the inner edges of the diaphragm 20 and the damper 22 of the woofer 6.

An elongated adjustable flexible arm or arms 40 has one end 42 attached to the back side 30 of the tweeter 4 and the other end 44 being aligned with the central opening 38 at the top end 34 of the elongated adapter member 32 and threadedly secured thereto by a threaded screw or adhesive means, such that the tweeter 4 can easily be adjusted in any direction within the open space 18 of the woofer 6. The adjustable arm member 40 is covered by an insulating material.

A grill member 46 made of metal or plastic material is detachably attached on an outer peripheral portion of the frame 14. The grill member 46 is provided for the purpose of covering the open space 18 of the woofer 6 and the tweeter 4. The composite speaker system 2 can be used without the grill member 46 as shown in FIG. 1 or it can be used with a factory grill that is already utilized in the automobile. One uniqueness of the present invention is that the tweeter is completely covered within the grill member 46 which can be of conventional shape and size. In other words, no enlarged or special shaped grill is needed to cover the woofer 6 and the tweeter 4.

The adjustable flexible arm 40 can be made from several materials. The manufacturing process which could accommodate the construction of the adjustable flexible arm 40 may be injection, thermoform, etc. or other molding process. By way of example only, the adjustable flexible arm 40 can be made of flexible metal material. It may be made of other flexible materials such as elastic synthetic rubber or the like. The tweeter 4 and the woofer 6 conform to conventional forms of manufacture.

Once the tweeter 4 is mounted within the open space 18 of woofer 6, the tweeter 4 can easily be adjusted in any direction for providing an aiming capability, thereby giving the listener up-front and live-performance sound.

It will be appreciated that the present invention is not limited to the composite speaker system for automotive vehicles. It is emphasized that while the present invention can be used in automotive vehicles, it is also within the spirit and scope of the present invention to utilize the adjustable flexible arm for speakers in home speaker systems.

Figure 3:
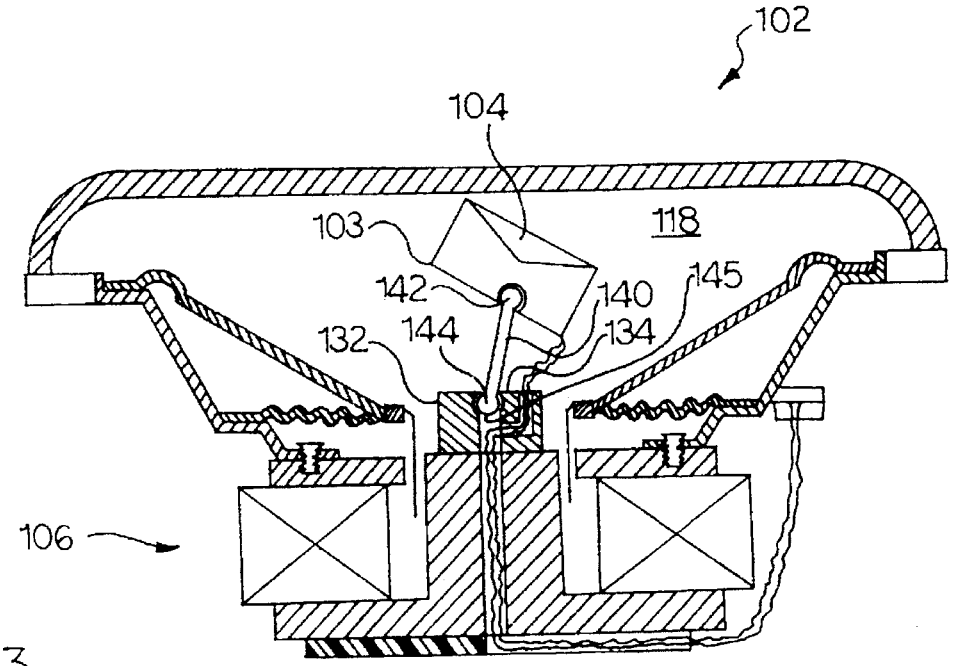
FIG. 3 cross-sectional view of another embodiment of the present invention composite speaker system having a tweeter which utilizes ball joints with an adjustable arm means attached to an elongated adapter means which is mounted to a pole piece of a woofer.

Referring to FIG. 3, there is shown a cross-sectional view of another embodiment of the present invention composite speaker system 102. It assembles and functions the same as previously described above except that an elongated rod 140 is substituted for the adjustable flexible arm 40. All other components are the same as previously described in FIGS. 1 and 2, and the description thereof will not be repeated and only the modified components will be described in detail. In this figure, the components are numbered correspondingly with 100 added to each number.

The elongated rod 140 has a ball joint end 142 attached to the back side 130 of the tweeter 104 and an opposite ball joint end 144 mounted at the top end 134 of the elongated adapter member 132 and secured thereto by a socket joint 145, and thereby the tweeter 104 can be adjusted in any direction within the open surface 118 of the woofer 106. The elongated rod 140 may be covered by an insulation material. One of the ball joints 142 or 144 may be eliminated as a simplified embodiment.

Figure 4:
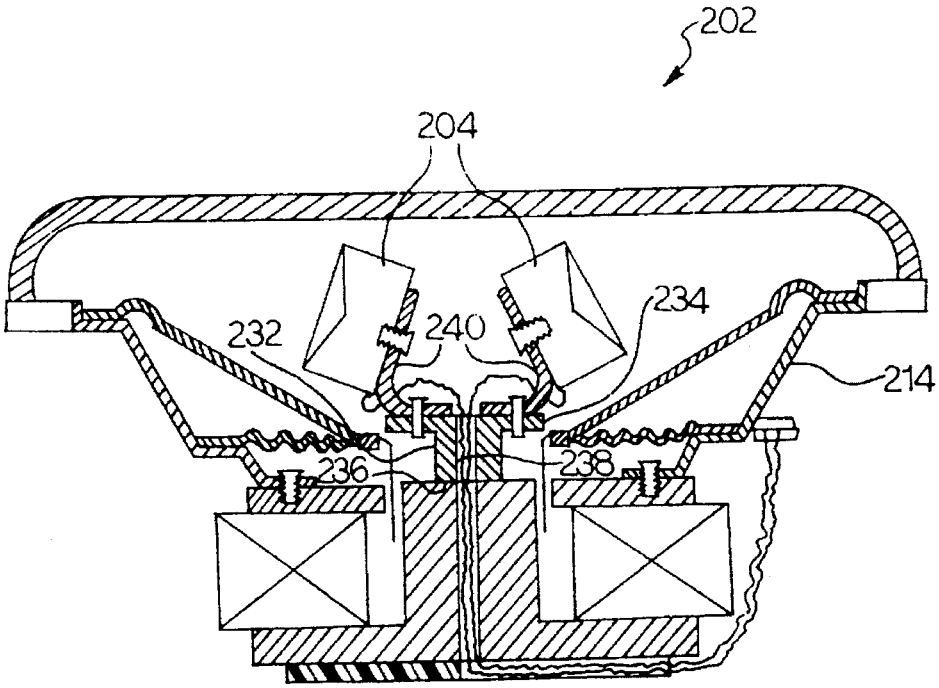
FIG. 4 is a cross-sectional view of still another embodiment of the present invention composite speaker system having multiple tweeters or transducers which are mounted to a wide flat platform on top of an adapter means which is in turn mounted to a pole piece of a woofer.

Referring to FIG. 4, there is shown a cross-sectional view of still another embodiment of the present invention composite speaker system 202 which represents a system of the triaxial, three-way type configuration. It assembles and functions the same as previously described in FIGS. 1 and 2, except that the elongated adapter member 232 has a platform top end 234 for adapting multiple tweeters or transducers. All other components are the same, and the description thereof will not be repeated and only the modified components will be described in detail. In this figure, the components are numbered correspondingly with 200 added to each number.

The platform top end 234 has a generally wide flat top which is utilized for mounting a plurality of tweeters or transducers 204. Only two transducers 204 are illustrated in this figure for the purpose of clarity. The elongated adapter member 232 has a central opening 238 extending through from the top end 234 to the bottom end 236 for the purpose of inserting and connecting the electrical wires from the transducers 204 to the input terminals mounted on the frame 214. The electrical wires may also be connected through the diaphragm and frame 214 of the woofer. Each transducer 204 will be mounted with an adjustable flexible arm 240 such that each transducer 204 can easily be adjusted individually in any direction for providing an aiming capability, thereby giving the listener up-front and live-performance sound. The plurality of transducers 204 can be a combination of tweeters and midrange speakers, or it can be a plurality of tweeters or a plurality of midrange speakers.

It will be appreciated that the present invention is not limited to the coaxial and triaxial types of configurations. It is also within the spirit and scope of the present invention to have quadriaxial, etc., types of configuration.

Figure 5:
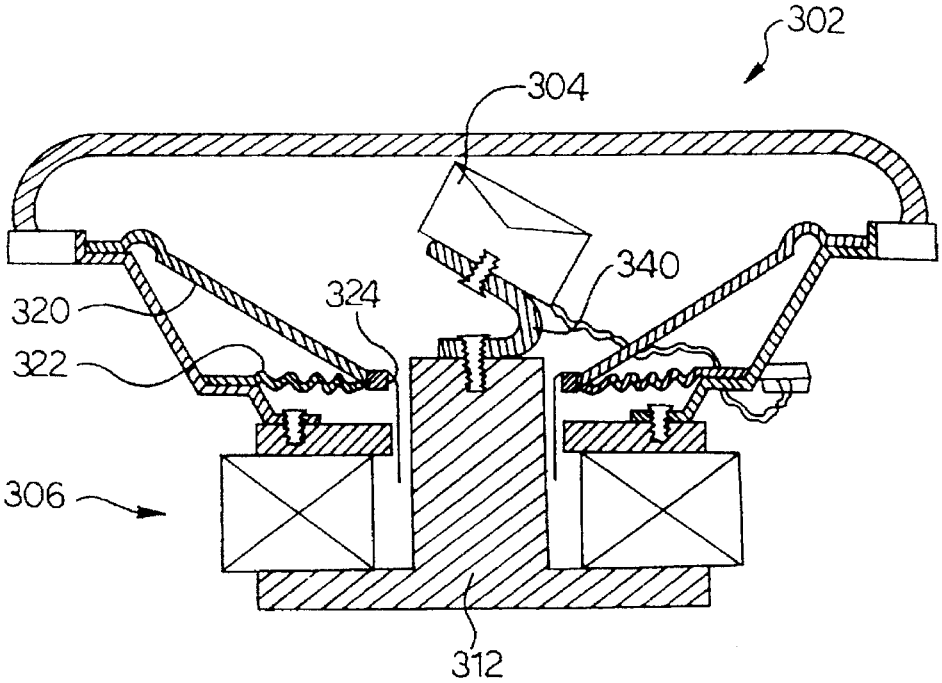
FIG. 5 is a cross-sectional view of a further embodiment of the present invention composite speaker system having a tweeter which is attached to an adjustable flexible arm which is in turn directly mounted to an extended pole piece of a woofer.

Referring to FIG. 5, there is shown a cross-sectional view of a further embodiment of the present invention composite speaker system 302. In this embodiment, the elongated adapter member 32 shown in FIGS. 1 and 2 is not utilized. All other components are the same, and the description thereof will not be repeated and only the modified components will be described in detail. In this figure, the components are numbered correspondingly with 300 added to each number.

In this embodiment, an extended pole piece 312 is utilized and extends upwardly above the central opening 324 formed by the inner edges of the damper 322 and the diaphragm 320 of the woofer 306. The adjustable flexible arm 340 is directly mounted to the extended pole piece 312. The flexible electrical wiring of the tweeter 304 is attached through the diaphragm 320 of the woofer 306 in a conventional manner.

Figure 6:
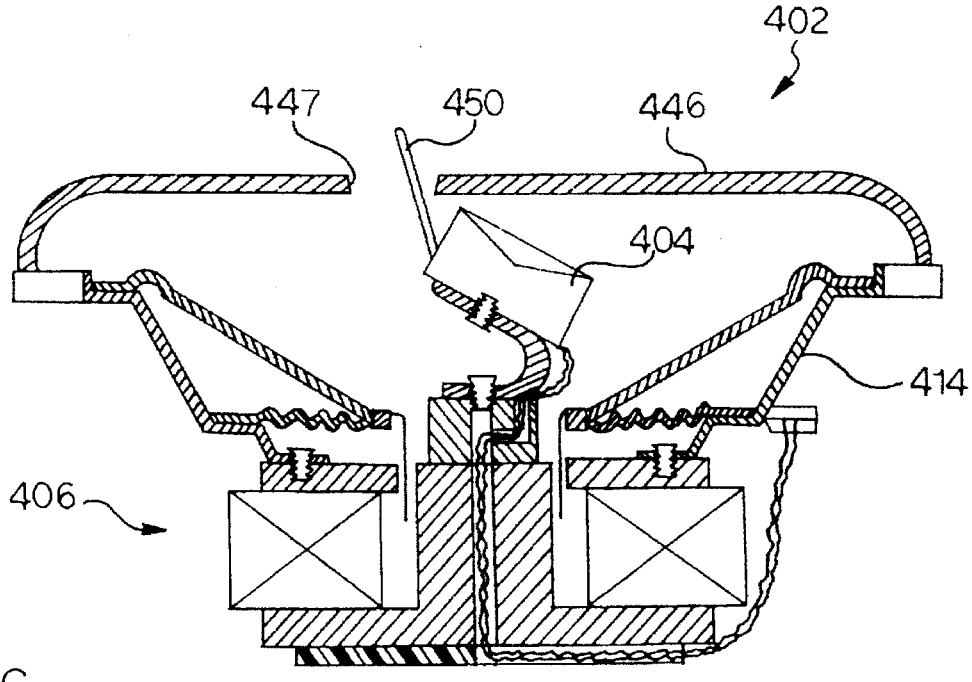
FIG. 6 is a cross-sectional view of an additional embodiment of the present invention composite speaker system having a tweeter mounted within a woofer and is adjusted by an elongated rod extending through a slot aperture on a grill.

Referring to FIG. 6, there is shown a cross-sectional view of an additional embodiment of the present invention composite speaker system 402. In this embodiment, the tweeter 404 and the grill member 446 are modified. All other components are the same as previously described in FIGS. 1 and 2, and the description thereof will not be repeated and only the modified components will be described in detail. In this figure, the components are numbered correspondingly with 400 added to each number.

An elongated rod 450 is attached to a side of the tweeter 404 for the purpose of adjusting the tweeter 404 when the grill member 446 is mounted on the frame 414. The grill member 446 has an enlarged slot aperture 447 for allowing the elongated rod 450 to extend out from the woofer 406 and to move side to side, or forward and backward or any other direction, and thereby the tweeter 404 can easily be adjusted in any direction by moving the elongated rod 450 without removing the grill member 446 from the frame 414.

Defined in detail, the present invention is a speaker system for vehicles, comprising: (a) a woofer for reproducing low frequency sounds and having a diaphragm, a damper, a pole piece extending from a bottom plate and a frame fixedly secured to a top plate, the damper having an outer edge mounted to the frame and an inner edge coupled to an inner edge of the diaphragm, the damper and the diaphragm mounted within an open space of the frame such that their inner edges form a central opening; (b) said pole piece having a central opening therethrough; (c) an elongated adapter member having a top end and a bottom end fixedly secured to said pole piece, where the top end of the elongated adapter member extends above said central opening formed by said diaphragm and said damper of said woofer; (d) a tweeter for reproducing high frequency sounds; (e) an adjustable flexible arm having one end attached to said tweeter and the other end mounted to said top end of said elongated adapter member, where said tweeter is located within said open space of said frame of said woofer such that said tweeter can be adjusted in any direction; and (f) a grill member detachably mounted on the periphery of said frame for covering said tweeter and said open space of said frame of said woofer; (g) whereby said tweeter can be adjusted in any direction for providing an aiming capability, thereby giving a listener up-front and live-performance sound.

Defined alternatively in detail, the present invention is a speaker system for vehicles, comprising: (a) a woofer for reproducing low frequency sounds and having a diaphragm, a damper, a pole piece extending from a bottom plate and a frame fixedly secured to a top plate, the damper having an outer edge mounted to the frame and an inner edge coupled to an inner edge of the diaphragm, the damper and the diaphragm mounted within an open space of the frame such that their inner edges form a central opening; (b) said pole piece having a central opening therethrough; (c) an elongated adapter member having a top end and a bottom end fixedly secured to said pole piece, where the top end of the elongated adapter member extends above said central opening formed by said diaphragm and said damper of said woofer; (d) a tweeter for reproducing high frequency sounds; (e) an elongated rod having at least one ball joint for attaching said tweeter to said top end of said elongated adapter member, where said tweeter is located within said open space of said frame of said woofer such that said tweeter can be adjusted in any direction; and (f) a grill member detachably mounted on the periphery of said frame for covering said tweeter and said open space of said frame of said woofer; (g) whereby said tweeter can be adjusted in any direction for providing an aiming capability, thereby giving a listener up-front and live-performance sound.

Defined also alternatively in detail, the present invention is a speaker system for vehicles, comprising: (a) a woofer for reproducing low frequency sounds and having a diaphragm, a damper, a pole piece extending from a bottom plate and a frame fixedly secured to a top plate, the damper having an outer edge mounted to the frame and an inner edge coupled to an inner edge of the diaphragm, the damper and the diaphragm mounted within an open space of the frame such that their inner edges form a central opening; (b) said pole piece having a central opening therethrough; (c) an elongated adapter member having a generally wide flat platform top end and a bottom end fixedly secured to said pole piece, where the platform top end of the elongated adapter member extends above said central opening formed by said diaphragm and said damper of said woofer; (d) at least two transducers for reproducing high and middle frequency sounds; (e) at least two adjustable flexible arms each having a first end and a second end, the first ends respectively attached to said at least two transducers, the second ends respectively mounted to said platform top end of said elongated adapter member, where said at least two transducers are located within said open space of said frame of said woofer such that said at least two transducers can be adjusted individually in any direction; and (f) a grill member detachably mounted on the periphery of said frame for covering said at least two transducers and said open space of said frame of said woofer; (g) whereby said at least two transducers can be adjusted individually in any direction for providing an aiming capability, thereby giving a listener up-front and live-performance sound.

Defined again alternatively in detail, the present invention is a speaker system for vehicles, comprising: (a) a woofer for reproducing low frequency sounds and having a diaphragm, a damper, an extended pole piece extending from a bottom plate and a frame fixedly secured to a top plate, the damper having an outer edge mounted to the frame and an inner edge coupled to an inner edge of the diaphragm, the damper and the diaphragm mounted within an open space of the frame such that their inner edges form a central opening; (b) said extended pole piece having a top end and extending upwardly above said central opening formed by said damper and said diaphragm; (c) a tweeter for reproducing high frequency sounds; (d) an adjustable flexible arm having one end attached to said tweeter and the other end mounted to said top end of said extended pole piece, where said tweeter is located within said open space of said frame of said woofer such that said tweeter can be adjusted in any direction; and (e) a grill member detachably mounted on the periphery of said frame for covering said tweeter and said open space of said frame of said woofer; (f) whereby said tweeter can be adjusted in any direction for providing an aiming capability, thereby giving a listener up-front and live-performance sound.

Defined broadly, the present invention is a speaker system having a woofer for reproducing low frequency sounds and a tweeter for reproducing high frequency sounds, the woofer having a diaphragm, a damper, a pole piece extending from a bottom plate and a frame fixedly secured to a top plate, the damper having coupled to an inner edge of the diaphragm, the damper and the diaphragm mounted within an open space of the frame such that their inner edges form an opening, the speaker system comprising: (a) an adapter member having a first end and a second end, the second end mounted to said pole piece and fixedly secured thereto, where the first end of the adapter member extends above said opening formed by said diaphragm and said damper of said woofer; and (b) a flexible arm member having one end attached to said tweeter and the other end mounted to said first end of said adapter member, where said tweeter is located within said open space of said frame of said woofer such that said tweeter can be adjusted in any direction; (c) whereby said tweeter can be adjusted in any direction for providing an aiming capability, thereby giving a listener up-front and live-performance sound.

Defined more broadly, the present invention is a speaker system having a first transducer and at least one second transducer, the first transducer having a pole piece, a frame mounted to a plate and a diaphragm mounted within an open surface of the frame, the diaphragm having a central opening, the speaker system comprising: (a) a supporting structure connected to said pole piece and extending through said central opening of said diaphragm; and (b) at least one flexible arm means having a first end and a second end, the first end attached to said at least one second transducer and the second end mounted to said supporting structure, where said at least one second transducer is located within said open space of said frame such that said at least one second transducer can be adjusted in any direction; (c) whereby said at least one second transducer can be adjusted in any direction for providing an aiming capability, thereby giving a listener up-front and live-performance sound.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A speaker system for vehicles, comprising:

a. a woofer for reproducing low frequency sounds and having a bottom plate, a top plate, a diaphragm, a damper, a pole piece extending from the bottom plate and a frame fixedly secured to the top plate, the damper having an outer edge mounted to the frame and an inner edge coupled to an inner edge of the diaphragm, the damper and the diaphragm mounted within an open space of the frame such that their inner edges form a central opening;

b. said pole piece having a central opening therethrough;

c. an elongated adapter member having a generally wide flat platform top end and a bottom end fixedly secured to said pole piece, where the platform top end of the adapter member extends above said central opening formed by said diaphragm and said damper of said woofer;

d. at least two transducers for reproducing high and middle frequency sounds;

e. at least two adjustable flexible arms each having a first end and a second end, the first ends respectively attached to said at least two transducers, the second ends respectively mounted to said platform top end of said adapter member, where said at least two transducers are located within said open space of said frame of said woofer such that said at least two transducers are adjusted individually in any direction; and f. a grill member detachably mounted on the periphery of said frame for covering said at least two transducers and said open space of said frame of said woofer;

g. whereby said at least two transducers are adjusted individually in any direction for providing an aiming capability.

2. The speaker system as defined in claim 1 wherein said at least two flexible arms are made of flexible metal material and covered by an insulating material.

3. The speaker system as defined in claim 1 wherein said elongated adapter member further comprises a central opening extending through from said wide flat platform top end to said bottom end for routing electrical wires through said adapter member, such that the central opening being aligned with said central opening of said pole piece.

4. The speaker system as defined in claim 1 wherein said at least two flexible arms are mounted to said platform top end of said elongated adapter member by screw means.

5. The speaker system as defined in claim 1 wherein said at least two transducers include a tweeter and a midrange speaker.

6. A speaker system for vehicles, comprising:

a. a first transducer for reproducing low frequency sounds and having a bottom plate, a top plate, a diaphragm, a damper, a pole piece extending from the bottom plate and a frame fixedly secured to the top plate, the damper having an outer edge mounted to the frame and an inner edge coupled to an inner edge of the diaphragm, the damper and the diaphragm mounted within an open space of the frame such that their inner edges form an opening;

b. an adapter member having a flat platform top end and a bottom end fixedly secured to said pole piece of said first transducer, where the platform top end extends above said opening formed by said diaphragm and said damper of said first transducer;

c. at least one second transducer for reproducing high frequency sounds; and d. at least one flexible arm having one end mounted to said platform top end of said adapter member and the other end attached to said at least one second transducer, where said at least one second transducer is located within said open space of said frame of said first transducer such that said at least one second transducer is adjusted in any direction;

e. whereby said at least one transducer is adjusted in any direction for providing an aiming capability.

7. The speaker system as defined in claim 6 further comprising a grill member detachably mounted on the periphery of said frame for covering said at least one second transducer and said open space of said frame of said first transducer.

8. The speaker system as defined in claim 6 wherein said at least one flexible arm is made of flexible metal material.

9. The speaker system as defined in claim 6 wherein said first transducer is a woofer.

10. The speaker system as defined in claim 6 wherein said at least one second transducer is a tweeter.

11. The speaker system as defined in claim 6 wherein said at least one second transducer is a midrange.

12. A speaker system having a first transducer and at least one second transducer, the first transducer having a plate, a pole piece, a frame mounted to the plate and a diaphragm mounted within the frame, the diaphragm having an opening, the speaker system comprising:

a. an adapter member having one end mounted to said pole piece and the other end extending above said opening of said diaphragm of said first transducer and forming a platform; and b. at least one flexible arm having one end mounted to said platform of said adapter member and the other end attached to said at least one second transducer, where said at least one second transducer is located within said frame of said first transducer such that said at least one second transducer is adjusted in any direction;

c. whereby said at least one second transducer is adjusted in any direction for providing an aiming capability.

13. The speaker system as defined in claim 12 further comprising a grill member detachably mounted on the periphery of said frame of said first transducer for covering said at least one second transducer.

14. The speaker system as defined in claim 12 wherein said at least one flexible arm is made of flexible metal material.

15. The speaker system as defined in claim 12 wherein said first transducer is a woofer.

16. The speaker system as defined in claim 12 wherein said at least one second transducer is a tweeter.

17. The speaker system as defined in claim 12 wherein said at least one second transducer is a midrange.

* * * * *